US005539364A

United States Patent [19]

Mader

[11] Patent Number: 5,539,364

[45] Date of Patent: Jul. 23, 1996

[54] RELAY

[75] Inventor: Leopold Mader, Mödling, Austria

[73] Assignee: EH-SCHRACK COMPONENTS Aktiengesellschaft, Wien, Austria

[21] Appl. No.: 269,005

[22] Filed: Jun. 30, 1994

[30] Foreign Application Priority Data

Jul. 2, 1993 [AT] Austria ..... 1312/93

[51] Int. Cl.[6] ..... H01H 67/02

[52] U.S. Cl. ..... 335/128; 335/130

[58] Field of Search ..... 335/78–86, 128, 335/124, 130

[56] References Cited

U.S. PATENT DOCUMENTS 5,202,663 4/1993 Tomono et al. ..... 335/86

5,250,919 10/1993 Schedele ..... 335/128

5,289,144 2/1994 Liao ..... 335/78

*Primary Examiner*—Lincoln Donovan

*Attorney, Agent, or Firm*—Henry M. Feiereisen

[57] ABSTRACT

Relay having a coil, a magnetic system and a contact system which is actuatable via a comb of an electrically insulating material by the magnetic system and includes two pole paths, with the contact system being arranged in a casing comprised of a base member and a cover. In order to accomplish a separation of the pole paths, the comb (6) has a plate-shaped lug (7) which is guided in grooves (9, 16) arranged in the base member (1) and/or in the cover (17) and which extends between two pole paths of the contact system.

6 Claims, 2 Drawing Sheets

RELAY

BACKGROUND OF THE INVENTION

The invention refers to a relay of a type having a coil, a magnetic system and a contact system which is actuatable via a comb of an electrically insulating material by the magnetic system and includes two pole paths, with the contact system being arranged in a casing comprised of a base member and a cover.

In such relays, the pole paths of the contact system are separated from each other either only through air paths or through fixed ribs, with the comb being configured mostly T-shaped or U-shaped and supported on the armature and the movable parts or engaged therein. The drawback of these known relays is the possibility of an arc-over between the pole paths in the event of excess voltages when the separation is accomplished only through air paths, and the difficulty of accomplishing a miniaturization because of the required air path and creepage paths between the pole paths in the embodiment with ribs.

SUMMARY OF THE INVENTION

It is the object of the invention to avoid these drawbacks and to propose a relay of the above-stated type in which an arc-over between the pole paths is prevented in a simple manner, and a miniaturized design is possible.

This is attained in accordance with the invention with a relay of the above-stated type by providing the comb with a plate-shaped lug which is guided in grooves arranged in the base member and/or in the cover and extends between two pole paths of the contact system.

These features ensure that the pole paths of the relay are separated from each other by an electrically insulating material, with the guidance of the comb in the grooves resulting in the advantage of achieving respectively long creepage paths.

In accordance with a feature of the present invention, the base member has a web projecting between the pole paths of the contact system and including a headpiece in which the groove that receives the comb lug is formed. These features result in the advantage that the comb can be kept relatively small and yet has a sufficient stiffness even at small thickness.

In accordance with another feature of the present invention, the cover has an inwardly projecting plate which extends parallel to the web of the base member and in which the groove for receiving the comb is formed. These features result in a very simple construction which effects a very secure guidance of the comb.

BRIEF DESCRIPTION OF THE DRAWING

The invention will now be described in more detail with reference to the drawing, in which.

DETAILED DESCRIPTION OF A PREFERRED EMBODIMENT

Figure 1:
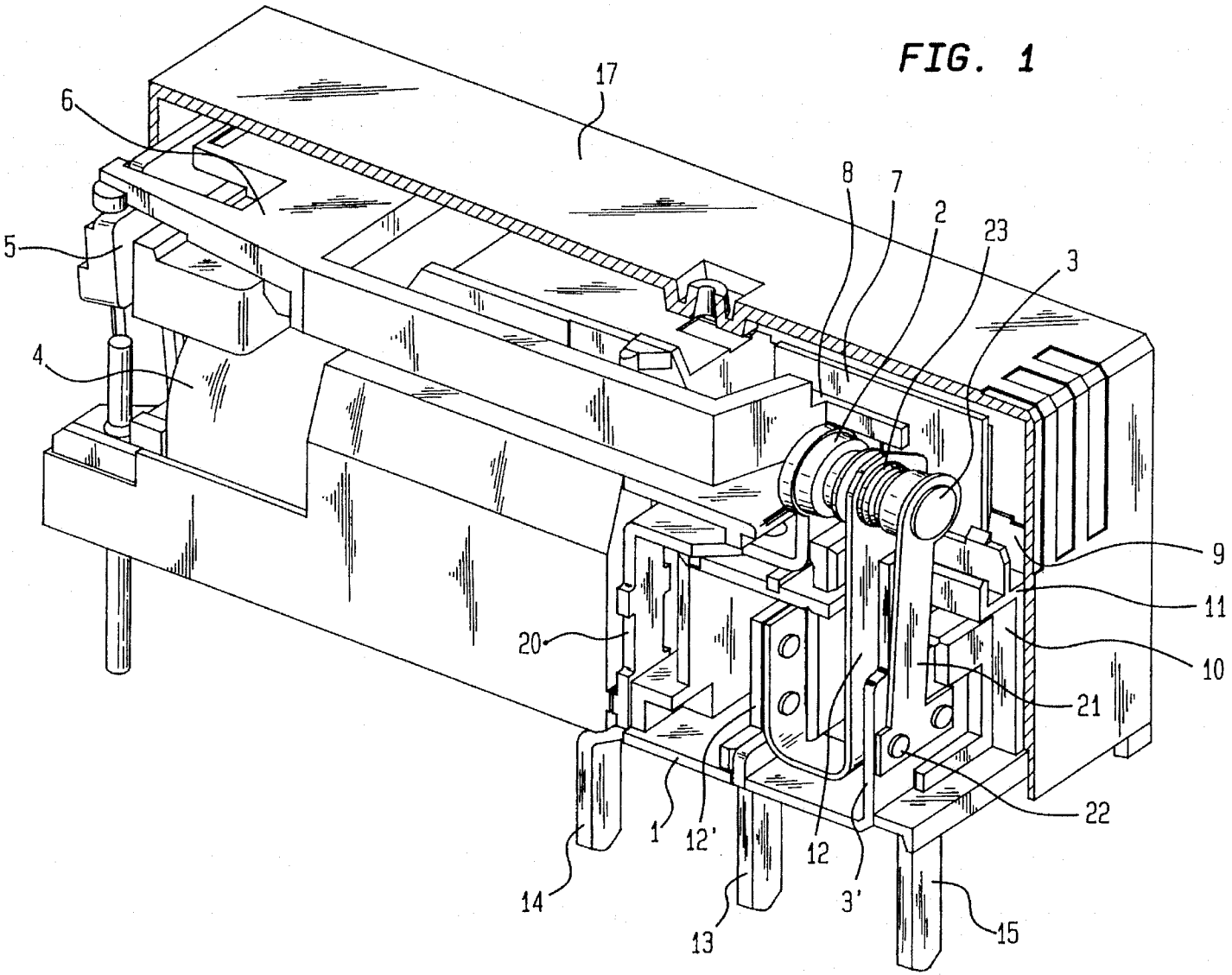
FIG. 1 is a schematic illustration of a relay according to the invention, with the casing cover being partially broken away.
Figure 3:
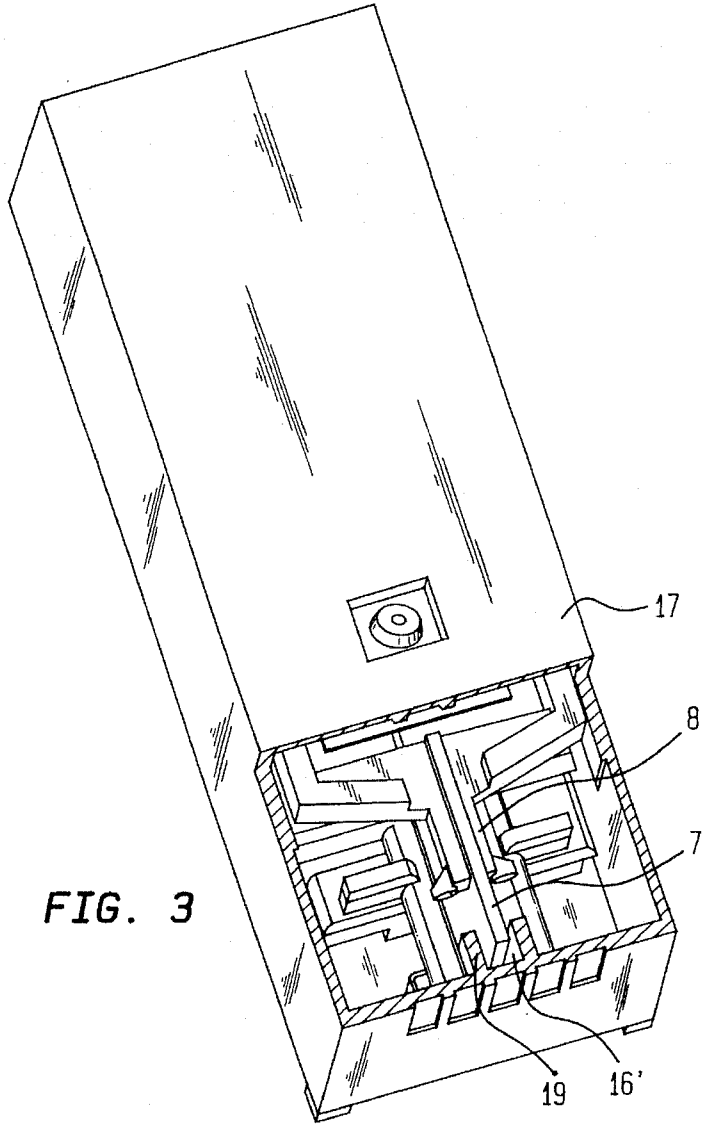
FIG. 3 shows an axiometric top view of the relay according to FIGS. 1 and 2, with the cover being partly broken away.

The relay includes a base member 1 which incorporates the fixed contacts 2 and 3 and the contact carriers 20, 3', respectively, with the contact system including two pole paths, of which only one is illustrated in FIG. 1.

Further retained in the base member is a coil 4 which receives a magnetic system, with an armature 5 engaging in a comb 6 which rests on the top of the receptacle of the coil 4 and is slidable thereon. The comb 6 is of essentially lyra-shaped configuration and holds a lug 7 between projections 8. This lug 7 is guided in a groove 9 which is formed in a web 10 of the base member 1 between the pole paths, with the groove 9 being arranged in a headpiece 11 of the web 10.

The projections 8 of the comb 6 serve simultaneously as engaging member for the moving contact spring 12 which carries a moving contact 23. This contact spring 12 is essentially of U-shaped configuration and is mounted on a contact carrier 12' which also includes a terminal lug 13. The fixed contact 21 is also provided with a terminal lug 14 as is the contact carrier 3' which includes a terminal lug 15, with the terminal lugs traversing the base member 1, and with a resilient holder 21 being secured by rivets 22 to the contact carrier 3' and holding the fixed contact 3 therein.

Figure 2:
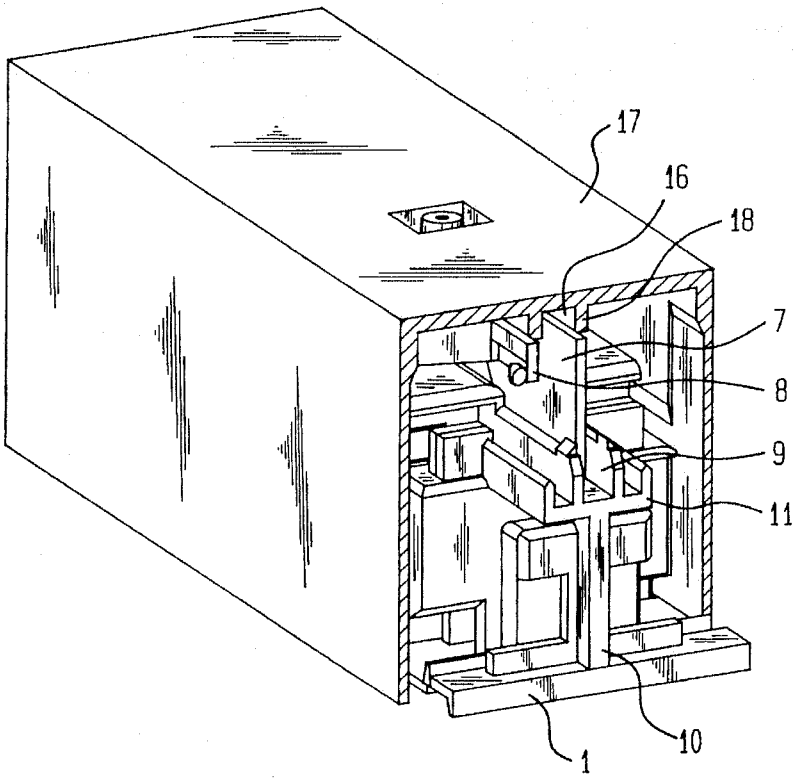
FIG. 2 shows the relay according to FIG. 1, with the front wall of the cover being broken away and with the contact system being omitted.

As shown in FIG. 2, the lug 7 may also be guided in a groove 16 of a cover 17 which groove is formed in an inwardly projecting plate 18.

The lug which like the comb 6 is made of an electrically insulating material separates together with the web 9 and the plate 18 of the cover 17 both pole paths of the contact system, of which only one 2, 3, 12 is illustrated.

I claim:

1. A relay, comprising:

a casing including a base member and a cover securable to the base member;

a contact system accommodated in the casing and including two pole paths; and a magnetic system for actuation of the contact system and including a coil attached to the base member and a comb that is made of an electrically insulating material and has a plate-shaped lug, wherein the casing is provided with a groove extending between two pole paths of the contact system and formed for guiding the plate-shaped lug.

2. The relay of claim 1 wherein the base member is formed with a groove.

3. The relay of claim 1 wherein the cover is formed with a groove.

4. The relay of claim 1 wherein the base member and the cover are each formed with a groove.

5. The relay of claim 1 wherein the base member has a web projecting between the pole paths of the contact system and including a headpiece in which the groove that receives the plate-shaped lug is formed.

6. The relay of claim 2 wherein the cover has an inwardly projecting plate which extends parallel to the web of the base member and in which the groove for receiving the comb is formed.

* * * * *